US005153033A

United States Patent [19]

Shibata et al.

[11] Patent Number: 5,153,033

[45] Date of Patent: Oct. 6, 1992

[54] COATING METHOD AND APPARATUS

[75] Inventors: Norio Shibata; Hiromu Ueha, both of Kanagawa, Japan

[73] Assignee: Fuji Photo Film Co., Ltd., Kanagawa, Japan

[21] Appl. No.: 597,224

[22] Filed: Oct. 15, 1990

[30] Foreign Application Priority Data

Oct. 16, 1989 [JP] Japan ..... 1-266330

[51] Int. Cl.[5] ..... B05D 3/12

[52] U.S. Cl. ..... 427/356; 118/410; 118/123

[58] Field of Search ..... 427/356; 118/410, 123

[56] References Cited

U.S. PATENT DOCUMENTS 4,537,801 8/1985 Takeda ..... 118/123 X
4,557,362 3/1986 Tanaka et al. ..... 118/123 X
4,613,526 9/1986 Nakamura et al. ..... 427/356
4,681,062 7/1987 Shibata et al. ..... 118/410
4,854,262 8/1989 Chino et al. ..... 427/356 X
4,870,920 10/1989 Kageyama et al. ..... 118/123 X
4,907,530 3/1990 Shibata et al. ..... 118/410
5,108,795 4/1992 Shibata et al. ..... 427/356

*Primary Examiner*—Michael Lusignan
*Assistant Examiner*—Diana Dudash
*Attorney, Agent, or Firm*—Sughrue, Mion, Zinn, Macpeak & Seas

[57] ABSTRACT

A coating system for applying a coating solution to a web includes a coating device for applying the coating solution to the web as it moves past the coating device, a doctor blade having a curved end face which corresponds to the curved configuration of the web as it moves past the end face. The end face of the doctor blade serves to scrape off any excess amount of coating solution applied to the web by the coating device.

3 Claims, 5 Drawing Sheets

COATING METHOD AND APPARATUS

BACKGROUND OF THE INVENTION

The present invention relates to a method for coating a belt-shaped flexible support of plastic film, paper, metal foil, or the like (hereinafter referred to as "a web") with a coating solution such as a photographing photo-sensitive solution, magnetic solution, surface protective solution, base coating solution, lubricant solution or the like, and to a coating apparatus for practicing the coating method.

A variety of methods have been proposed in the art to apply a coating solution to a web which is being run.

One such coating method employs a doctor blade. In this method, after the web is sufficiently coated with the coating solution, excess coating solution is scraped off the web with the doctor blade, and the coating solution remaining on the web is smoothed to form a desired film layer thereon. A coating apparatus for practicing the method is simpler in construction than an extrusion type coating apparatus. In addition, the coating operation is simple, and a thin film can be formed on the web at a high speed.

One example of the coating method using a doctor blade is disclosed in Japanese Patent No. 62-4189.

In the method, the doctor blade is provided with a backup roller. The backup roller is rigid, and is confronted with the doctor blade. Hence, foreign matter on the web is liable to be caught in the gap between the doctor blade and the web. The foreign matter thus caught may form stripes on the web, and at worst may break the web. The coating rate is controlled by adjusting the gap between the end of the doctor blade and the cylindrical wall of the backup roller. For instance, in forming a film layer on the web at a coating rate of 10 $cc/m^2$ or less, it is necessary to set the gap to 20 $\mu m$ or less, with the result that the above-described problem will not take place often. However, it is very difficult to set the gap to an extremely small value such as 20 $\mu m$. Furthermore, oscillation of the backup roller greatly affects the accuracy of the gap, thus varying the film thickness both in the direction of width of the web and in the direction of movement of the web.

In a conventional dust removing method of this type, the doctor blade employed is higher in dust removing effect since it is sharper edged, and the object of such a doctor blade is to remove, as much as possible, coating solution from the web. Thus, the dust-removing doctor blade does not function as the doctor blades of the above-described coating method. Specifically, the doctor blade functions only as a dust removing member. However, the conventional arrangement of the dust-removing doctor blade employed in a coating apparatus is not acceptable as means for stably controlling the thickness of a film layer formed on the web. Thus, the doctor blade is still disadvantageous. Research on this difficulty has not been sufficiently conducted in the art.

SUMMARY OF THE INVENTION

The present invention was developed after intensive research on the coating method discussed above, and on the dust removing method disclosed in Japanese Patent Application No. 200664/1985 so as to eliminate the difficulty that the formation of a film layer on the web is affected by the backup roller.

Accordingly, an object of this invention is to provide a coating method in which the above-described difficulties accompanying a conventional coating method using a doctor blade, which heretofore has been considered to be unacceptable in formation of a film layer on the web, have been eliminated, and a film layer can be formed on the web free from requirements for a high accuracy of the web supporting means, and with which the formation of stripes on the web is suppressed, and it is unnecessary to use a coating apparatus which is intricate in construction for the formation of a film layer high in quality. The invention further provides a coating apparatus for practicing the coating method.

The foregoing object of the invention has been achieved by the provision of a coating apparatus in which a web being run is coated with a coating solution, and excess coating solution is scraped off the web with a doctor blade which is arranged so as to depress the web laid in tension as required, the doctor blade having front and rear walls, as viewed in the direction of movement of the support, which are extended in the direction of the depression, and a doctor end face which is curved towards the web and in the direction of movement of the web so as to confront the web, and the web is run substantially along the doctor end face of the doctor blade so that excess coating solution is scraped off the web. Further, a coating method according to the invention employs the above-described coating apparatus, and a coating solution is applied to the web by controlling at least one of the following factors: the curvature of the doctor end face of the doctor blade, the incident angle of the web to the doctor blade, the emergent angle of the web from the doctor blade, and the tension of the web.

The term "web" as used herein is intended to include flexible belt-shaped materials which are generally several centimeters to several meters in width, several tens of meters or more in length and several to several hundred of microns in thickness, such as plastic films of polyethylene terephthalate, polyethylene-2, 6-naphthalate, cellulose diacetate, cellulose triacetate, cellulose acetate propionate, polyvinyl chloride, polyvinylidene chloride, polycarbonate, polyimide and polyamide; papers formed by coating or laminating paper $\alpha$-polyolefins two to ten in the number of carbons such as polyethylene, polypropylene and ethylene-butene copolymer; metal foils such as aluminum foils, copper foils and tin foils; and belt-shaped materials formed by forming preliminary layers on the above-described flexible belt-shaped materials.

The web is coated with a coating solution such as a photographing photo-sensitive solution, a magnetic solution, a surface protective solution, a charge preventing solution or smoothing coating solution, depending on its use. The web thus coated is cut to a desired width and length. Typical examples of the web thus cut are photographing films, photographic papers, magnetic tapes, and magnetic disks.

DESCRIPTION OF THE PREFERRED EMBODIMENTS

Preferred embodiments of the invention will be described with reference to the accompanying drawings in detail.

Figure 1:
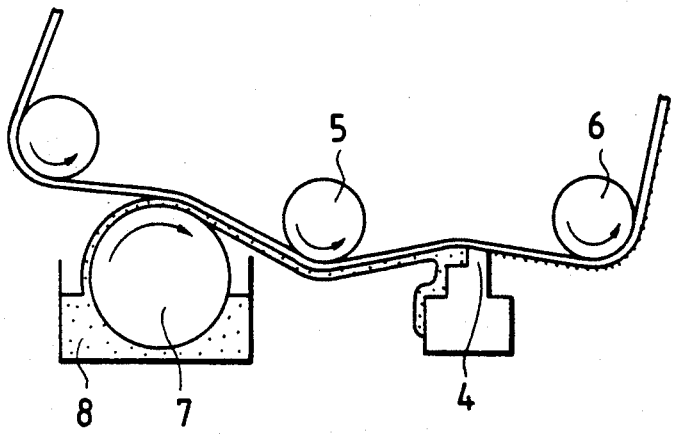
FIG. 1 is a side view showing a preferred embodiment of a coating apparatus of this invention.
Figure 2:
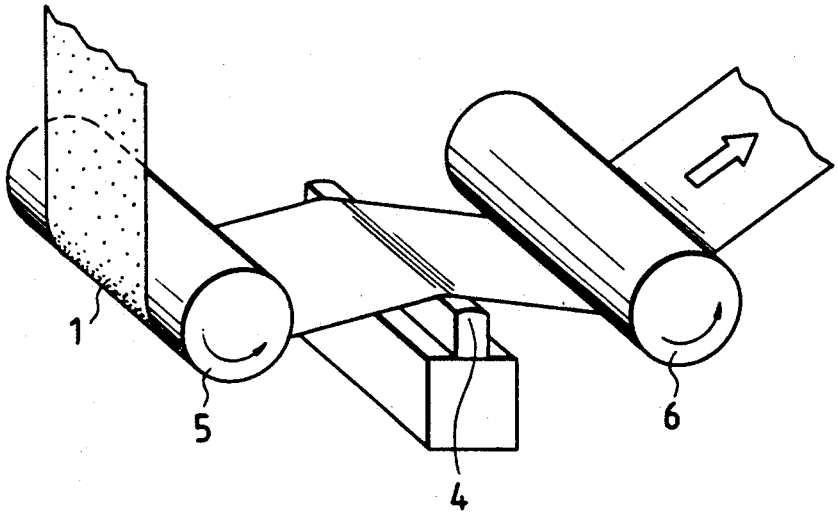
FIG. 2 is a perspective view showing essential components of the coating apparatus shown in FIG. 1.

FIG. 1 is a side view showing one example of a coating apparatus according to the invention. As shown in FIG. 1, a coating solution 8 is applied to a web 1 with a coating roller 7, and the web 1 thus coated is conveyed by a web conveying unit while being supported by supporting rollers 5 and 6. A blade 4 is arranged between the supporting rollers 5 and 6 in such a manner that it extends in the direction of the web's width, or in a direction perpendicular to the direction of movement of the web. With the blade 4 pushed against, but not in contact with the web 1 the coating solution 8 is partially removed from the web 1.

Figure 3:
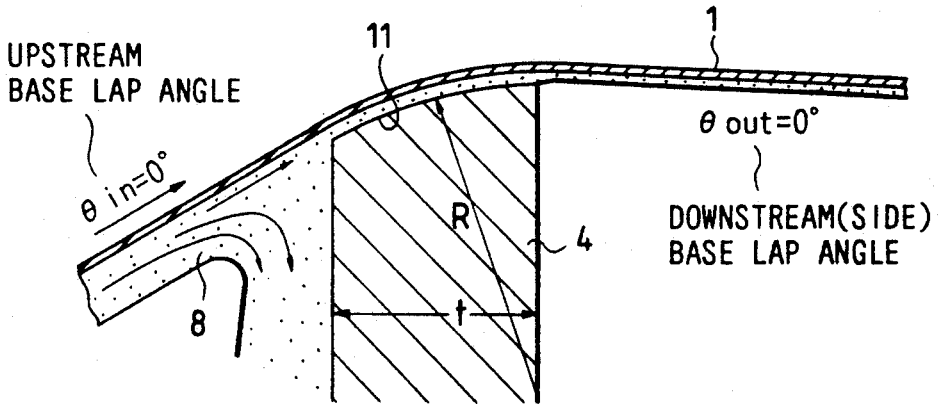
FIG. 3 is an enlarged sectional view showing the end portions of a blade in the coating apparatus according to the invention.

FIG. 3 is an enlarged sectional view of the end portion of the blade 4, showing how the coating solution is partially scraped off the web. The end face 11 of the blade 4, which confronts the web 1, is curved with a curvature R of, for example, 2 to 30 mm. The web 1 is allowed to meet the blade with an upstream base lap angle $\theta_{in}$ set in a range of from 0.5° to 2°, which is the angle of incidence to the end face 11 (the angle with the tangent X to the front edge). When, under the condition that the end face of the blade 4 is curved with the above-described curvature, and the angle $\theta_{in}$ is set as described above, the tension of the web 1 is set to a suitable value, and an angle of emergence, or downstream base lap angle $\theta_{out}$, is set to a suitable value, then the gap between the web 1 and the end face 11 can be reduced to less than 2 μm so that the quantity of coating solution passing through the gap can be decreased to a small value. When the web 1 is allowed to meet the blade while lapping on the latter substantially in the direction of the tangent to the end face 11, foreign matter in the coating solution 8 is not trapped; that is, foreign matter readily moves over the end face 11, thus passing through the gap.

As the coating solution 8 is partially scraped off by the blade 4 having the curved end face 11, a thin layer of coating solution remains as was described above. Furthermore, since no support (backup roll) is confronted through the web 1 with the blade 4, foreign matter on the web passes over the end face of the blade more readily than in the case where a doctor blade with a backup roller is employed. As a result, the probability of the formation of stripes on the web or breakage of the web is greatly reduced. This is due to the fact that an excellent film of coating solution can be formed on the web by setting film control conditions with these reasons taken into account.

(1) As the upstream base lap angle $\theta_{in}$ (the tangent to the upstream edge of the end face 11 is at 0°, with the opening side being positive) increases, the quantity of coating is increased. In the case when the lap angle is decreased, with $\theta_{in}$ at approximately 0° the quantity of coating is liable to be abruptly changed by the action of the blade's upstream edge.

(2) As the downstream base lap angle $\theta_{out}$ (the tangent to the downstream edge of the end face 11 is 0°, with the opening side being positive) increases, the quantity of coating is decreased.

Adjustment of the quantity of coating according to the above-described paragraphs (1) and (2) can be achieved more readily as the thickness t of the blade 4 is decreased.

(3) The quantity of coating is increased substantially in proportion to the curvature R of the blade. This is due to the fact that, in the case where the bending rigidity of the web can be disregarded, the liquid pressure at the blade end is inversely proportional to the curvature R.

(4) The quantity of coating is decreased as the tension of the web increases. This is due to the fact that, similarly as in the case of the curvature R of the blade, the liquid pressure at the blade end is increased with the increasing tension of the web.

The blade 4 is made of cemented carbide such as WC-TAC, or hard material such as fine ceramics, alumina A-150 or zirconia. Alternatively, at least the surface of the blade 4 is made of the above-described material. The surface of the blade 4 is 0.5 μm or less in $R_{MAX}$; that is, it is high in smoothness.

As was described above, in the coating apparatus of the invention, the doctor blade is so positioned as to depress the web between the supporting rollers which is laid in tension as required, and has the front and rear walls which are extended in the direction of depression, and the end face which is curved towards the web and in the direction of movement of the web so as to confront with the coated surface, and the web is allowed to lap on the blade in such a manner that it goes substantially along the curved end face. Hence, in the coating apparatus of the invention, substantially no foreign matter in the coating solution is trapped, and the coating thickness can be readily controlled by adjusting the above-described lap angles and tension of the web. Thus, the difficulty accompanying the conventional doctor blade type coating method has been eliminated. That is, according to the invention, a thin film layer of coating solution can be stably formed on the web independently of the accuracy of the web supporting means or the manner in which the web is supported. Thus, with the coating apparatus of the invention, which is simple in construction, a thin film can be satisfactorily formed on the web at all times. In addition, the coating apparatus is easy to maintain.

As conducive to a full understanding of the invention, concrete examples thereof will be described:

EXAMPLE 1

The coating solution shown in Table 1 below was applied to webs under the following conditions according to the method of the invention and to the conventional method using a doctor blade with a backup roll, to detect the formation of stripes on the webs and the thickness of the film layers formed on the same.

| | |
|---|---|
| 1. Precoating rate | 50 cc/m$^2$ |
| 2. Support (web) | |
| Material | PET film |
| Thickness | 15μ |
| Width | 300 mm |
| Tension | 6 kg/entire width |
| Speed of movement | 300 m/min |
| 3. Doctor blade | |

(1) Method of the Invention —— A doctor blade as shown in FIG. 3 was used. The radius of curvature R was 3 mm and the thickness t was 1.0 mm.

Figure 4:
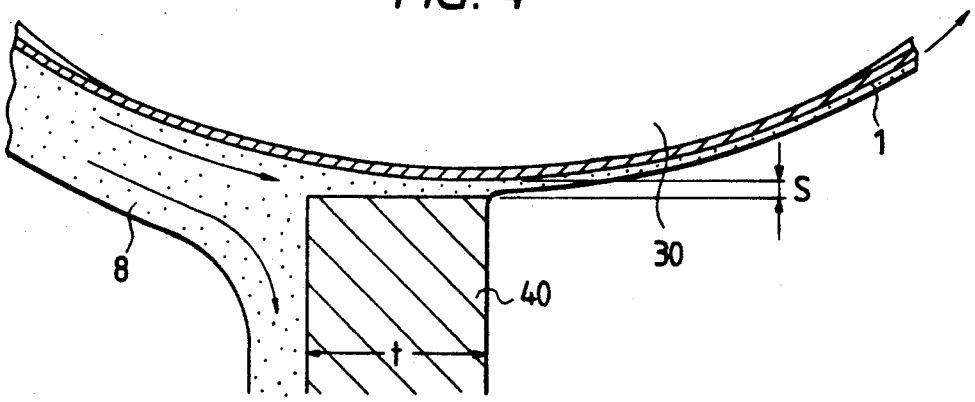
FIG. 4 is an enlarged sectional view showing a doctor blade in a conventional coating apparatus.

(2) Conventional Method —— A doctor blade with a backup roller as shown in the FIG. 4 was used. The thickness t of the blade 40 was 3.0 mm, the diameter of the backup roller 30 was 200 mm, and the gap S was 16 μm.

Under the above-described conditions, coating operations were carried out according to the method of the invention and to the conventional method, with a coating rate of 8 cc/m$^2$ in both methods. When each of the webs were coated with 5000 m of the coating solution, the numbers of stripes formed on the webs and the variations in thickness of film layers formed thereon are as indicated in Table 2 below. As is apparent from Table 2, the method of the invention is superior to the conventional method. In addition, it can be understood that, in the method of the invention, the thickness of a film layer can be controlled by adjusting the upstream blade lap angle $\theta_{in}$ and the downstream blade lap angle $\theta_{out}$. On the other hand, in the coating operation according to the conventional method (FIG. 4), the thickness of the film layer formed was not uniform. This difficulty is mainly due to the periodic oscillation of the backup roll. More specifically, it is estimated that the difficulty results from the periodic variation of the gap between the end face of the doctor blade and the backup roll.

EXAMPLE 2

The effects of the doctor blade's curvature R, the web's incident angle to the blade (the upstream blade lap angle $\theta_{in}$), the emergent angle from the blade (the downstream blade lap angle $\theta_{out}$), and the web tension on the quantity of residual coating were detected under the following basic conditions:

| | |
|---|---|
| 1. Precoating rate | 50 cc/m$^2$ |
| 2. Support (web) | |
| Material | PET film |
| Thickness | 15μ |
| Width | 300 mm |
| Speed of movement | 300 m/min |
| 3. Coating solution | Coating solution prepared by dispersing the components as shown in Table 1. |

Effects of the Curvature R of the Doctor Blade

Figure 5:
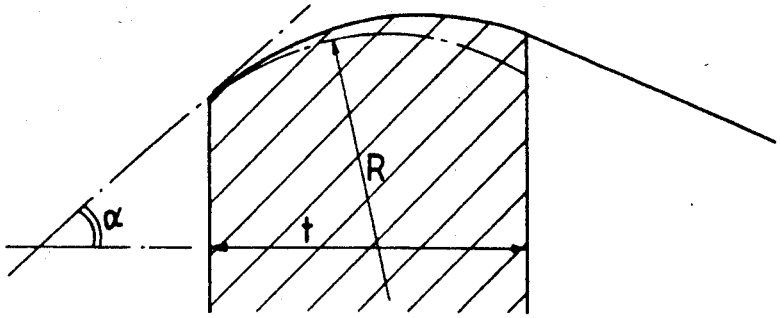
FIG. 5 is a side view showing the variation in curvature of the end portion of the blade in the coating apparatus of the invention.
Figure 6:
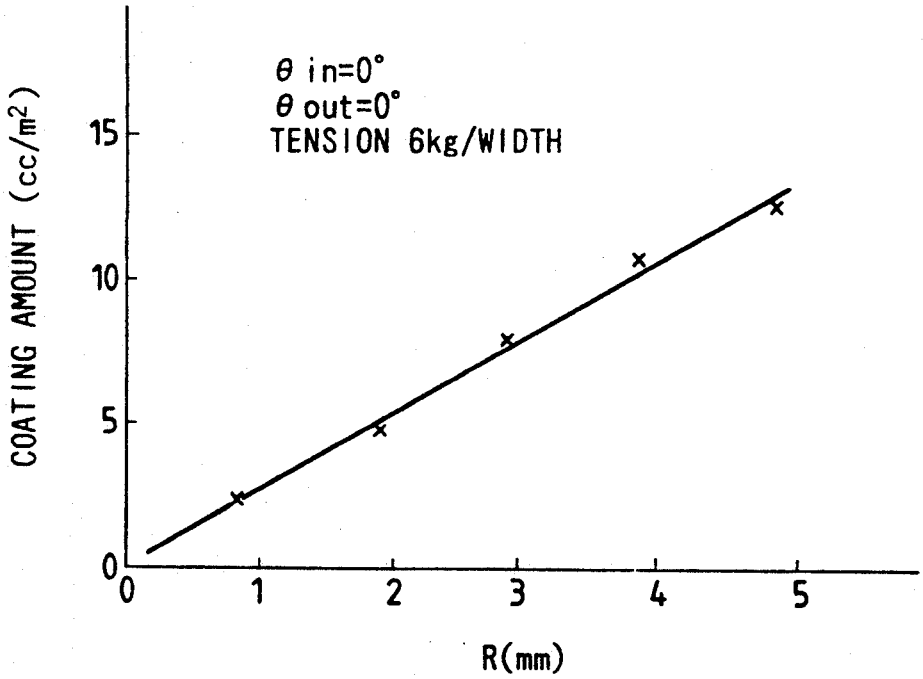
FIG. 6 is a graph indicating blade end face curvature with quantity of coating.

As shown in FIG. 5, the angle α of the tangent to the upstream edge was fixedly set to 11.5° and the blade thickness t to 1.0 mm. Under this condition, the curvature R was changed to detect variations in the quantity of residual coating. As is apparent from FIG. 6, the quantity of coating can be controlled so that the thickness of a film layer formed on the web is increased substantially in proportion to the increasing curvature R.

Figure 7:
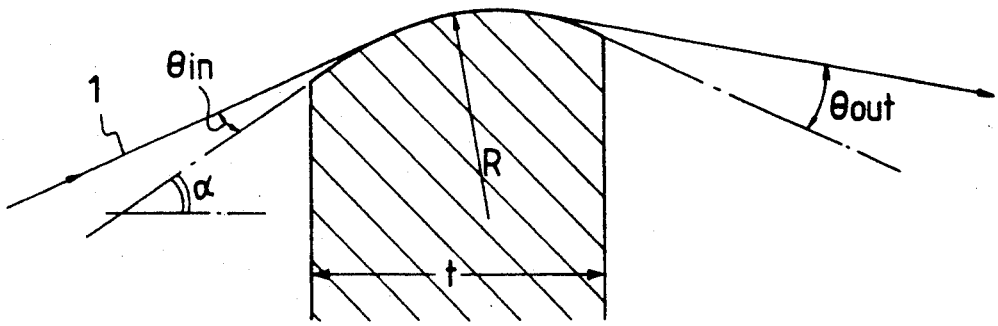
FIG. 7 is a side view showing an upstream blade lap angle $\theta_{in}$ and a downstream blade lap angle $\theta_{out}$ in the embodiment of the invention.
Figure 8:
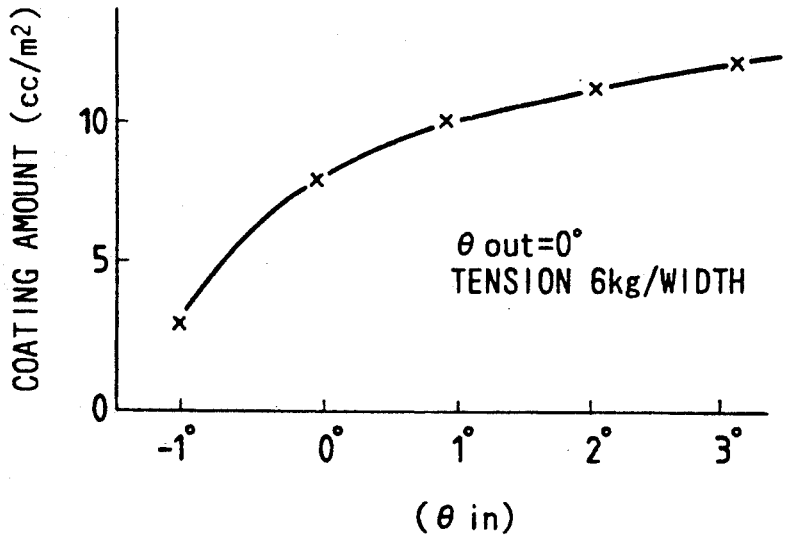
FIG. 8 is a graph indicating upstream blade lap angle $\theta_{in}$ with the quantity of coating.
Figure 9:
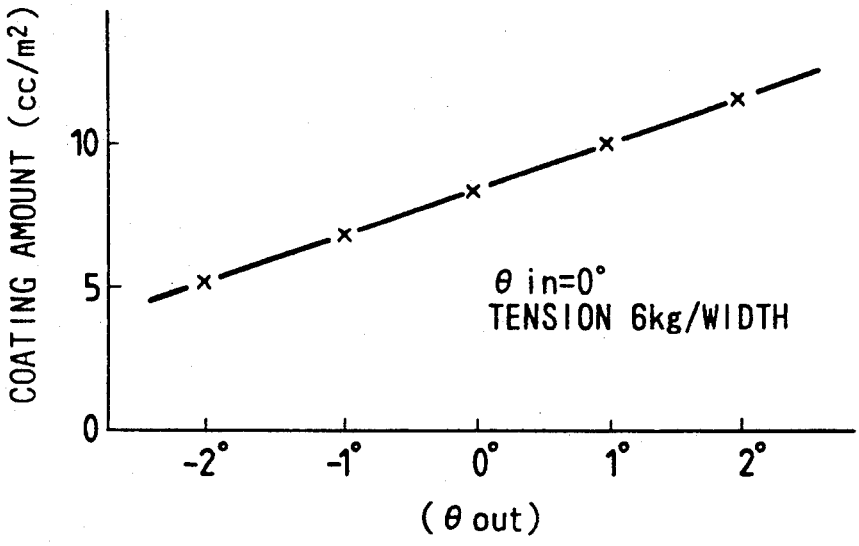
FIG. 9 is a graph indicating downstream blade lap angle $\theta_{out}$ with the quantity of coating.

Effects of the Web's Incident Angle (Upstream Blade Lap Angle $\theta_{in}$) to the Blade, and the Web's Emergent Angle (Downstream Blade Lap Angle $\theta_{out}$) from the Blade With a doctor blade shaped as shown in FIG. 7, the effects of the web's incident angle $\theta_{in}$ and emergent angle $\theta_{out}$ on the quantity of residual coating were as indicated in FIGS. 8 and 9, respectively. As is seen from FIGS. 8 and 9, in the case of the incident angle $\theta_{in}$, as zero is reached, abrupt change occurs, and thereafter the variation is relatively moderate; and in the case of the emergent angle $\theta_{out}$, the variation is substantially linear. In both cases, the quantity of coating can be stably controlled by adjusting the angle of the web with respect to the blade.

Effects of Web Tension

Figure 10:
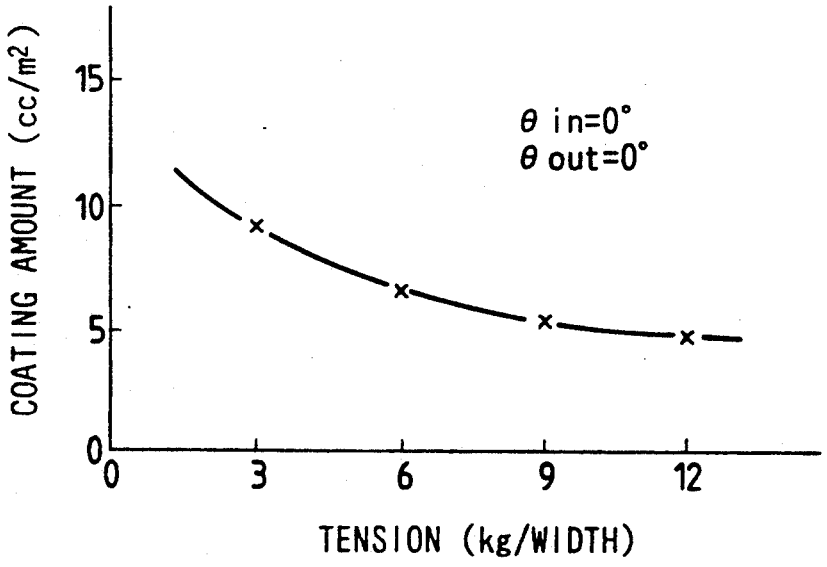
FIG. 10 is a graph indicating web tension with the quantity of coating.

With the doctor blade as shown in FIG. 7 (t = 1.0 mm, R = 3.0 mm), the effects of the web tension were as indicated in FIG. 10. As is apparent from FIG. 10, the film thickness is decreased as the tension increases. That is, the quantity of residual coating can be controlled by adjusting the tension of the web.

TABLE 1

| | parts by weight |
|---|---|
| γ-$Fe_2O_3$ powder (acicular particles 0.5 μm in average major diameter grain size, and 320 oersteds in coercive force) | 300 |
| Vinyl chloride - vinyl acetate copolymer (copolymerization ratio 87:13, copolymerization degree 400) | 30 |
| Electrically conductive carbon | 20 |
| Polyamide resin (amine value 300) | 15 |
| Lecithin | 6 |
| Silicon oil (dimethylpolysiloxane) | 3 |
| Xylole | 300 |
| Methylisobutylketone | 400 |
| n-butanol | 200 |

Those components were dispersed with a ball mill for fourteen hours (14 h). The coating solution thus prepared had a viscosity of 4.5 poise with $10^{sec-1}$ and 0.4 poise with $500^{sec-1}$.

TABLE 2

| | Number of stripes | Thickness variation |
|---|---|---|
| This invention (FIG. 3) | 1 | 2% |
| Prior Art (with the doctor 29% blade having the backup roll, FIG. 4) | 19 | 29% |

In Table 2, "thickness variation" = {(maximum thickness variation)/(average thickness)} × 100 (%).

What is claimed is:

1. A method of coating a moving web with a coating solution comprising the steps of:

a first moving step of moving a web past a coating means which applies a coating solution to the moving web;

a second moving step of moving the coated web past a doctor blade having an end face which confronts the moving web and which has a curved configuration so that an excess amount of applied coating solution is scraped off of the web by said end face so as to meter the amount of solution remaining on said web, said second moving step moving the web such that the web has a curved configuration as it moves past said doctor blade, the curved configuration of the web corresponding to the curved configuration of said end face; and adjusting an amount of applied coating solution scraped off of the web by said end face by controlling at least one of a radius of curvature of said end face, an incident angle of the web to said doctor blade, an emergent angle of the web from said doctor blade, and a tension of the web.

2. The method as defined in claim 1, wherein the radius of curvature of said end face is controlled to be between 2 and 30 mm.

3. The method as defined in claim 1, wherein the incident angle is controlled to be between 0.5° and 2.0°.

* * * * *